US006613148B1

(12) United States Patent
Rasmussen

(10) Patent No.: US 6,613,148 B1
(45) Date of Patent: Sep. 2, 2003

(54) METHOD AND APPARATUS FOR APPLYING HIGHLY VISCOUS LIQUID TO SUBSTRATE

(75) Inventor: Robert T. Rasmussen, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/370,665

(22) Filed: Aug. 9, 1999

Related U.S. Application Data

(62) Division of application No. 08/599,439, filed on Jan. 18, 1996, now Pat. No. 5,935,653.

(51) Int. Cl.[7] ..... B05C 3/00
(52) U.S. Cl. ..... 118/401; 118/50
(58) Field of Search ..... 118/401, 50, 679, 118/683, 674, 680, 681, 264, 266

(56) References Cited

U.S. PATENT DOCUMENTS

| | | | | | |
|---|---|---|---|---|---|
| 2,647,488 | A | * | 8/1953 | Shive | |
| 3,486,482 | A | * | 12/1969 | Hunger | |
| 4,370,356 | A | * | 1/1983 | Bok et al. | 118/401 |
| 4,529,628 | A | | 7/1985 | Haour et al. | 427/319 |
| 4,696,885 | A | | 9/1987 | Vijan | 430/311 |
| 4,938,994 | A | | 7/1990 | Choinski | 427/96 |
| 5,270,079 | A | | 12/1993 | Bok | 427/429 |
| 5,339,329 | A | | 8/1994 | Flinchum et al. | 427/319 |
| 5,455,062 | A | * | 10/1995 | Muhlfriedal et al. | |
| 5,556,665 | A | | 9/1996 | Norris et al. | 427/64 |
| 5,633,045 | A | | 5/1997 | Smith et al. | 427/428 |
| 6,139,639 | A | * | 10/2000 | Kitamura et al. | |

* cited by examiner

*Primary Examiner*—Brenda A. Lamb
(74) *Attorney, Agent, or Firm*—Hale and Dorr LLP

(57) ABSTRACT

A method for coating flat substrates with a liquid, the method comprising: pressurizing liquid within a coat head wherein the liquid has a viscosity of at least thirty centipoises; forming a meniscus of liquid at an orifice in the coat head; contacting the meniscus of the liquid to the substrate; and moving the meniscus relative to the substrate. A system for coating a flat substrate with liquid, the system comprising: a coat head filled with liquid by capillary action, wherein the viscosity of the liquid is at least thirty centipoises; a pressurizer of the liquid that forms a meniscus at an orifice in the coat head; a contacter of the meniscus to the substrate; and a mover of the meniscus relative to the substrate. A system for coating a flat substrate with liquid, the system comprising: a coat head filled with liquid, wherein the viscosity of the liquid is at least thirty centipoises; a pressurizer of the liquid that forms a meniscus at an orifice of the coat head; a contacter of the meniscus to the substrate; a mover of the meniscus relative to the substrate; a regulator of liquid pressure at the base of the coat head; and a replenisher of liquid that replenishes liquid taken from the coat head with liquid in a reservoir.

23 Claims, 7 Drawing Sheets

METHOD AND APPARATUS FOR APPLYING HIGHLY VISCOUS LIQUID TO SUBSTRATE

CROSS-REFERENCE TO RELATED APPLICATION

This application is a divisional of Ser. No. 08/599,439, filed Jan. 18, 1996 now U.S. Pat. No. 5,935,653.

This invention was made with Government support under Contract No. DABT63-93-C0025, awarded by the Advanced Research Project Agency (ARPA). The Government has certain rights in this invention.

FIELD OF THE INVENTION

This invention relates to application methods and apparatuses for applying uniformly thick coatings on flat substrates.

BACKGROUND OF THE INVENTION

In the photolithographic process, a polymeric photo resist layer is formed on a thin film to be etched and then exposed to actinic radiation through a photo mask, e.g., by contact printing. Actinic radiation renders one portion of the photo resist relatively more soluble, and the other portion relatively less soluble. The more soluble portion of the photo resist is removed, e.g., by solubilization with a suitable solvent, uncovering portions of the thin film. The uncovered portions of the thin film are then removed by etching, leaving behind a facsimile or reverse facsimile of the photo mask pattern. However, variations in the thickness of the applied polymeric photo resist layer generate imperfections in the photo mask pattern. One way to ensure a uniformly thick polymeric photo resist layer is to apply highly viscous resist.

Techniques which have been developed for formation of the film of the photometric photo resist include: meniscus coating (see U.S. Pat. No. 5,270,079 incorporated herein by reference), slot coating (see U.S. Pat. No. 4,696,885 incorporated herein by reference), and patch coating (see U.S. Pat. No. 4,938,994 incorporated herein by reference). However, these methods have many disadvantages; for example, there is excess waste of the photo resist, only substrates of limited size may be accommodated, they produce a film coating of non-uniform thickness, and they produce an edge bead build up at the end of the coating. In particular, the meniscus coating method allows too much solvent evaporation and patch coating is a complicated, unproven technique.

Capillary coating is a superior method that applies a more uniformly thick layer of photo resist to substrates, does not produce an edge bead build up, can handle larger substrate sizes, and does not allow solvent to evaporate. Referring to FIG. 1, a capillary apparatus is shown wherein the substrate (1) is held by a vacuum chuck (2). The vacuum chuck (2) is positioned above a coat head (3) of photo resist. The coat head (3) of photo resist is in fluid communication with a photo resist reservoir (4). The photo resist travels from the reservoir (4) up through the coat head (3) to an orifice at the top of the coat head where it forms a meniscus. The vacuum chuck (2) is then made to bring the substrate (1) into contact with the meniscus. The vacuum chuck (2) then moves the substrate (1) laterally, relative to the coat head (3). As the vacuum chuck (2) is moved horizontally relative to the coat head (3), a layer (5) of photo resist is coated onto the substrate (1). This method provides a uniformly thick layer because the flow of resist onto the substrate is adequately controlled by the capillary action. However, capillary action is only effective for fluids having a viscosity of less than thirty centipoises, because the capillary action is not strong enough to pull highly viscous liquids up through the coat head (3).

Therefore, there is a need for a capillary type method of applying fluids having viscosities of greater than thirty centipoises.

SUMMARY OF THE INVENTION

The present invention introduces a slight pressure differential between the photo resist at the bottom of the coat head and at the meniscus to assist the capillary action in moving viscous liquid up the coat head. This allows capillary systems to apply fluids having viscosities of greater than thirty centipoises. This method may be used to apply any fluid, within the above parameters, for any purpose, as understood by those skilled in the art, besides the photolithographic process identified above.

According to one aspect of the invention, there is provided a system for coating a flat substrate. One embodiment of this invention comprises: a coat head filled with liquid by capillary action, wherein the viscosity of the liquid is at least thirty centipoises; a pressurizer of the liquid that forms a meniscus at an orifice in the coat head; a contacter of the meniscus to the substrate; and a mover of the meniscus relative to the substrate.

According to a further embodiment of the invention, there is provided a system comprising: a coat head filled with liquid, wherein the viscosity of the liquid is at least thirty centipoises; a pressurizer of the liquid that forms a meniscus at an orifice of the coat head; a contacter of the meniscus to the substrate; a mover of the meniscus relative to the substrate; a regulator of liquid pressure at the base of the coat head; and a replenisher of liquid that replenishes liquid taken from the coat head with liquid in a reservoir.

According to another aspect of the present invention, there is provided a method for coating flat substrates. One embodiment of this aspect comprises: pressurizing liquid within a coat head wherein the liquid has a viscosity of at least thirty centipoises; forming a meniscus of liquid at an orifice in the coat head; contacting the meniscus of the liquid to the substrate; and moving the meniscus relative to the substrate.

BRIEF DESCRIPTION OF THE DRAWING

The present invention will be better understood by reading the following description of nonlimitative embodiments, with reference to the attached drawings wherein like parts in each of the several figures are identified by the same reference character, and which are briefly described as follows.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
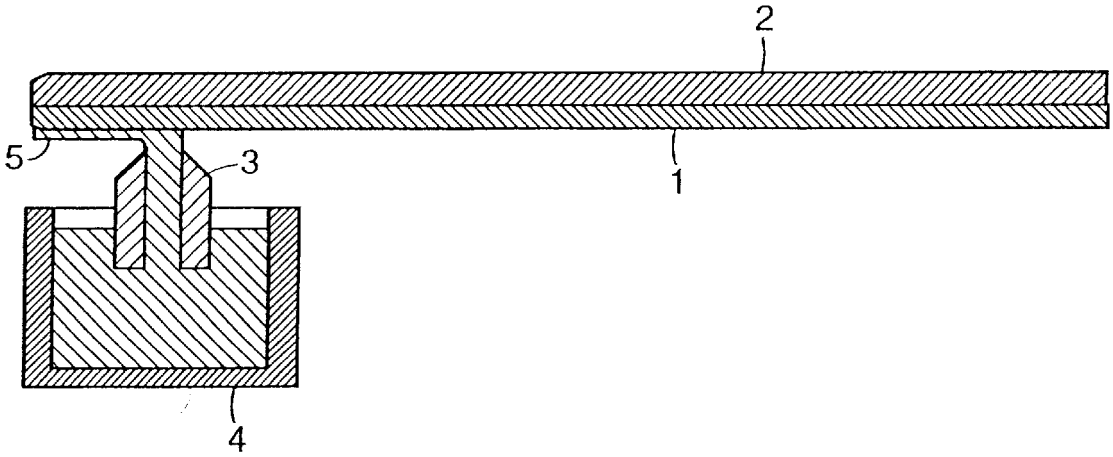
FIG. 1 (PRIOR ART)
FIG. 1 is a cross-sectional view of one embodiment of the invention.
Figure 2:
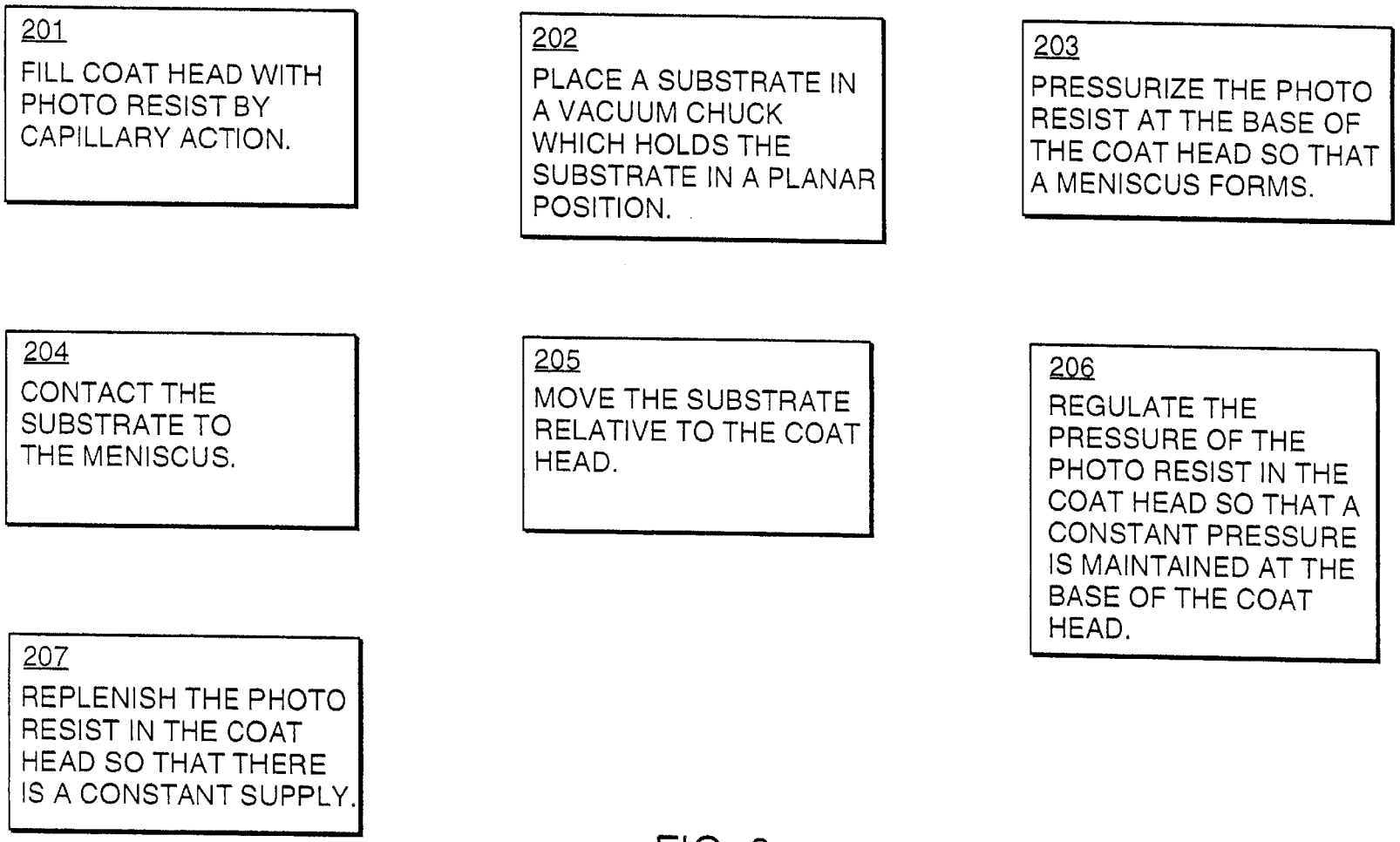
FIG. 2 is a diagram of a method for coating substrates with a liquid layer.

Referring to FIG. 2, there is described a method for applying a uniformly thick layer of photo resist on a substrate. Initially, a coat head is filled (201) with photo resist by capillary action. A substrate to be coated is placed (202) in a vacuum chuck that holds the substrate completely flat. Any warp or bend in the substrate causes a variation in the thickness of the photo resist layer. The photo resist in the coat head is then pressurized (203) at the bottom of coat head so that photo resist will continue to rise in the coat head to form a meniscus at the top. The substrate is then brought into contact (204) with the meniscus. The substrate is then moved (205) relative to the meniscus so that a layer of photo resist forms on the substrate. During the movement (205) of the substrate, the pressure of the photo resist is regulated (206) so that the pressure at the bottom of the coat head remains constant, slightly above atmospheric pressure. This prevents fluctuations in the flow of photo resist through the coat head so that the thickness of the layer on the substrate is of uniform thickness. Also, during the movement (205) of the substrate, the photo resist in the coat head is replenished (207) with photo resist from a reservoir so that a constant supply is provided to the coat head.

The thickness of the photo resist layer (5) is dependent upon several parameters. These parameters include: the velocity of the substrate (1) relative to the coat head (3), the viscosity of the photo resist, the surface tension of the photo resist, the width of the meniscus, the height of the coat head (3), the distance between the coat head orifice and the substrate (1), and added pressure for driving photo resist up the coat head (3). Thus, given the desired thickness of the photo resist layer (5), these parameters may be varied.

An increase of the substrate (1) velocity relative to the coat head (3) increases the thickness of the film layer (5). The relationship is nearly linear up to approximately 25 millimeters per second, but the slope of the curve declines at higher speeds. The more viscous the photo resist, the thicker the layer (5). A more narrow meniscus (narrow coat head) results in thinner film layers (5) because the photo resist is not able to work its way up the coat head (3) as easily. The height of the coat head (3) and the pressure of the photo resist in the reservoir (4) are related parameters in that they define the pressure of the photo resist at the bottom of the coat head (3). In order to maintain constant flow of liquid up through the coat head (3) to the meniscus, the pressure of the photo resist in the reservoir (4) must be increased if the coat head (3) height is increased. An increase in the photo resist pressure in the reservoir (4) or a reduction in the height of the coat head (3) results in a thicker photo resist layer (5). Thus, pressure in the reservoir (4) is provided to gently push photo resist up the coat head (3) where capillary action is not strong enough to pull a sufficient amount of photo resist up the coat head (3). Thus, any single parameter may be modified or any combination thereof to create the correct system parameters to obtain the desired photo resist layer thickness.

Figure 3:
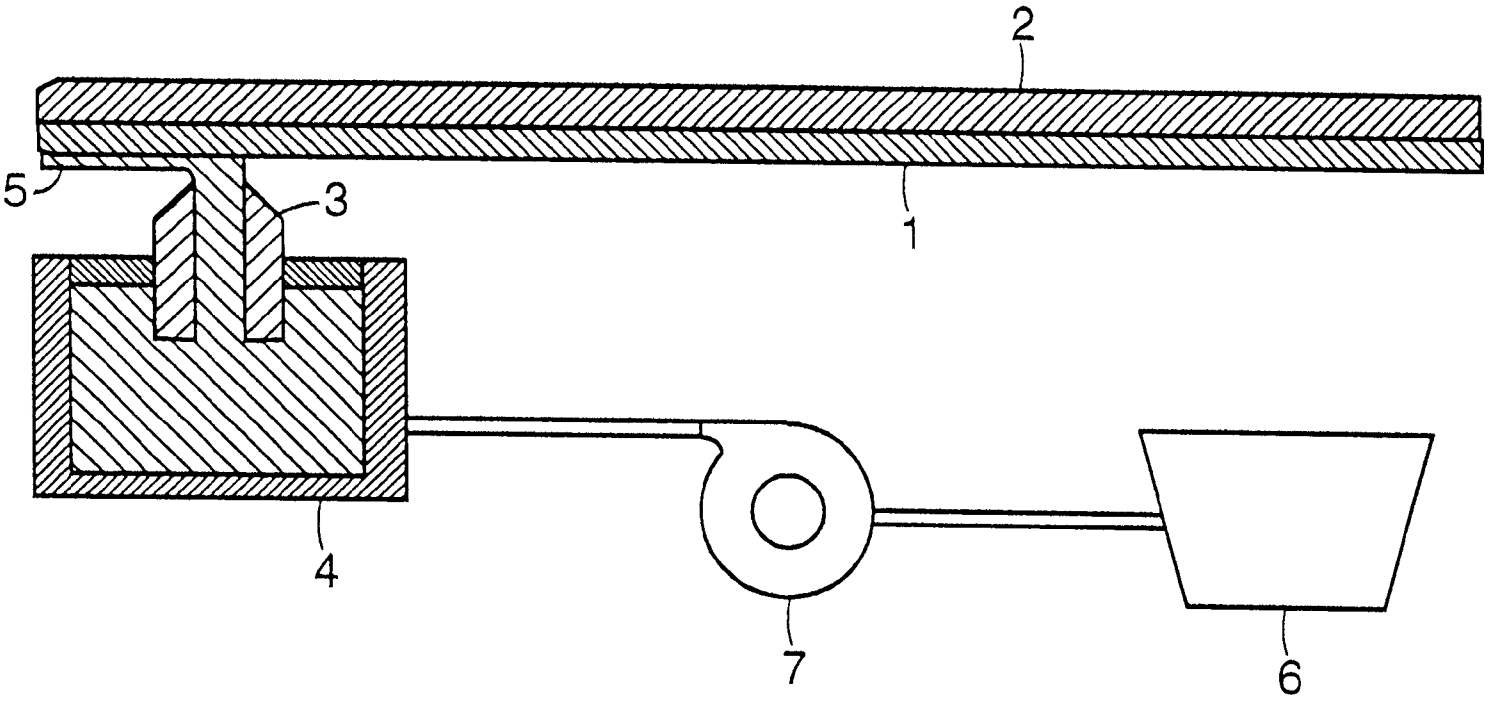
FIG. 3 is a diagram of an embodiment of the invention.

Referring to FIG. 3, the substrate (1) is attached to a vacuum chuck (2). Photo resist is pumped from a source tank (6) by a pump (7) into the reservoir (4). Any type of low volume, low pressure pump well known in the art may be used. In this embodiment, the reservoir (4) is enclosed: so that the positive pressure induced by the pump (7) is directly translated to the coat head (3). The photo resist rises in the coat head (3) by capillary action, assisted by positive pressure induced by pump (7), to form a layer (5) on the substrate (1). The pump (7) may be controlled by an electrical mechanical pressure control system so that the pressure induced by the pump (7) remains constant.

Figure 4:
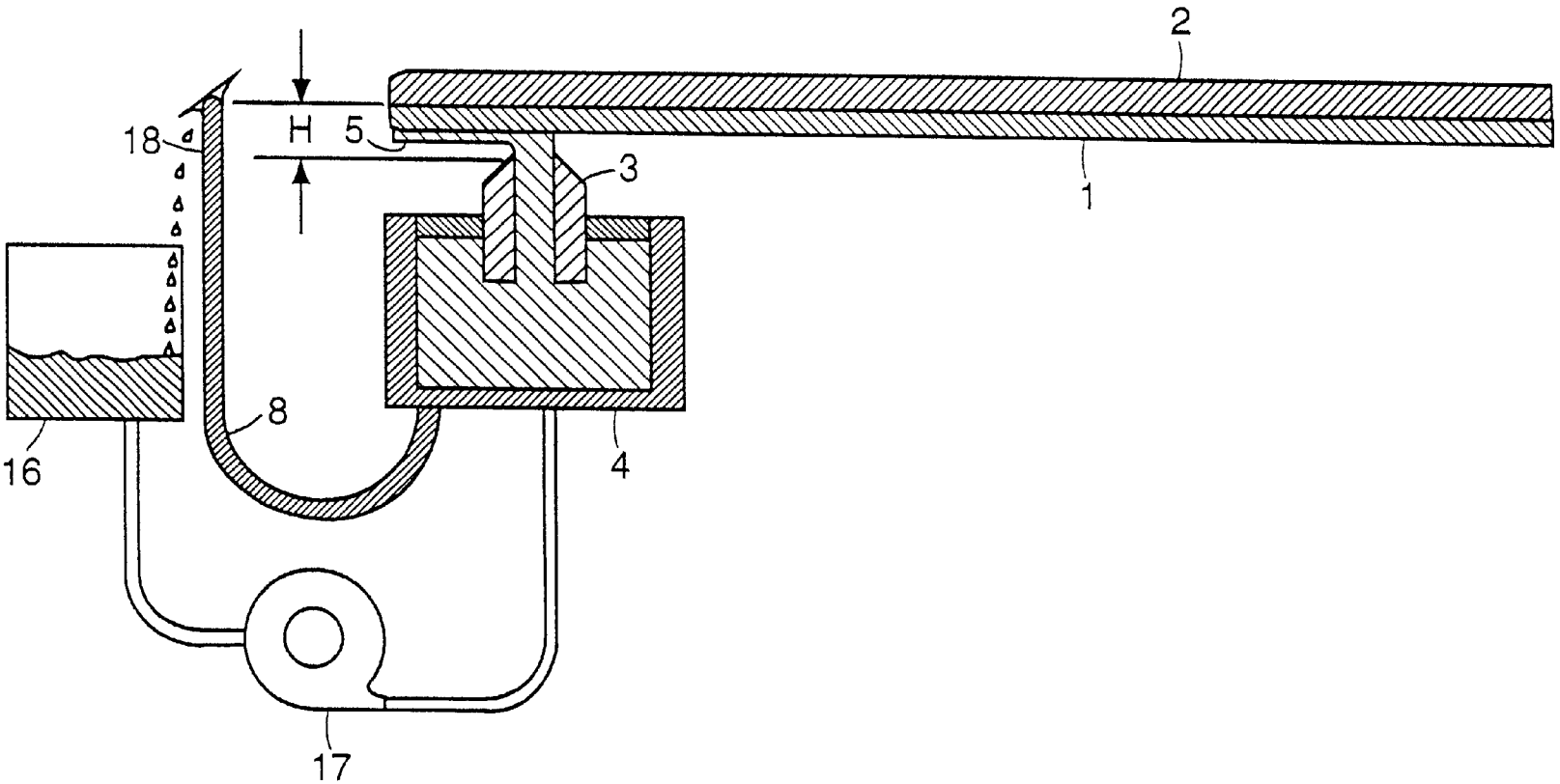
FIG. 4 is a diagram of an embodiment of the invention.

Referring to FIG. 4, a further embodiment of the invention is shown. Again, the substrate (1) is attached to a vacuum chuck (2). A stand-pipe (8) is attached to the reservoir (4) so that positive pressure may be induced in the reservoir (4). In this embodiment, the reservoir (4) is enclosed so that the positive pressure induced by the stand-pipe (8) is directly translated to the photo resist at the base of the coat head (3). The amount of pressure is determined by the height (H) of the photo resist in the stand pipe (8) relative to the meniscus. The height (H) is constantly maintained by pump (17). Pump (17) pumps overflow photo resist received in receptacle (16) into reservoir (4). The photo resist either enters the coat head (3) or stand-pipe (8). The surplus photo resist exists stand-pipe (8) via spillway (18) and falls into receptacle (16). Because the height of the photo resist is thereby maintained, the elevated pressure in the reservoir (4) remains constant.

Figure 5:
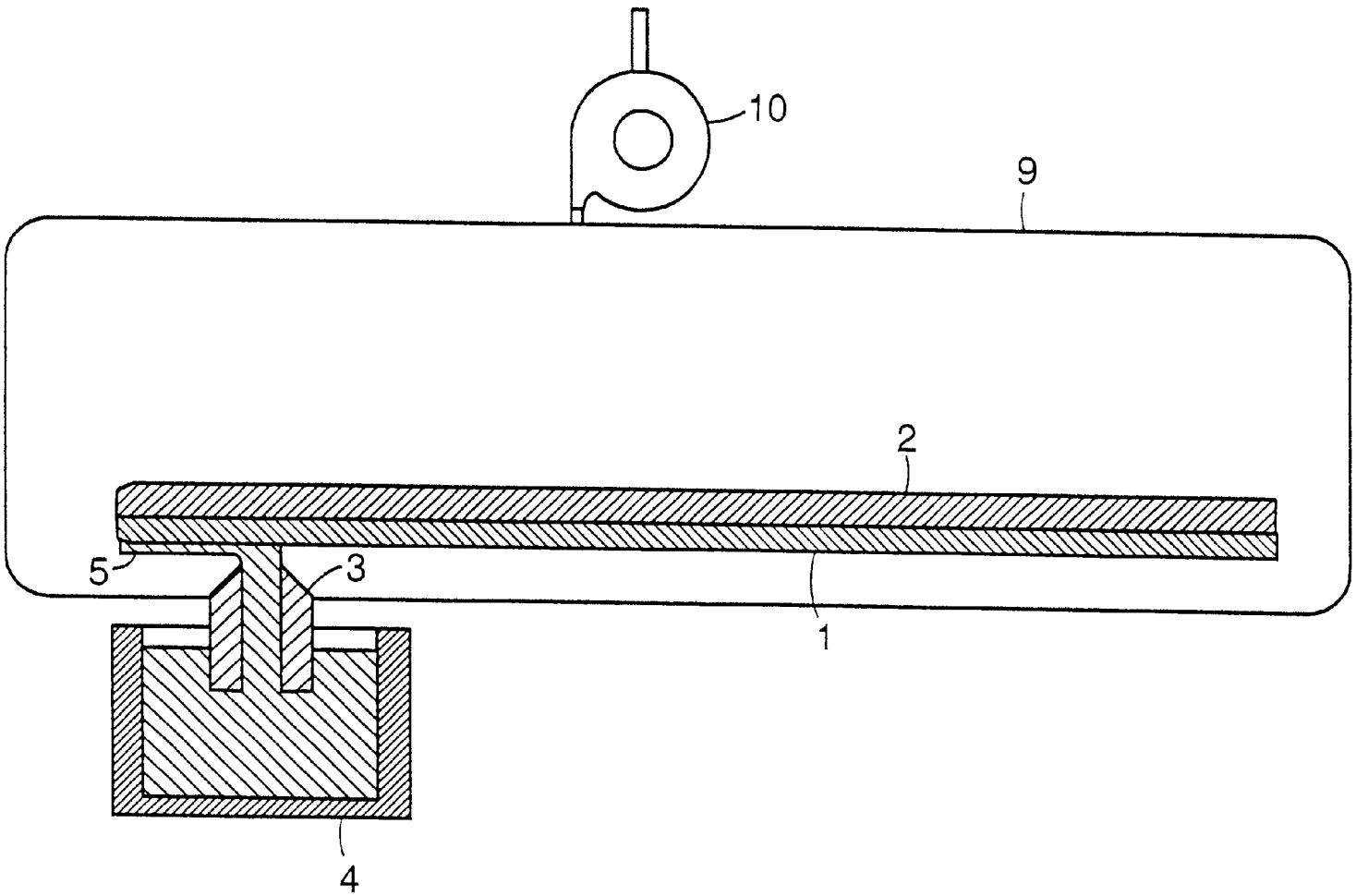
FIG. 5 is a diagram of an embodiment of the invention.

Referring to FIG. 5, a still further embodiment of the invention is shown. Here the vacuum chuck (2) and substrate (1) are enclosed by a structure (9). The coat head (3) protrudes into the structure (9) so that photo resist may be applied to the substrate (1). Pump (10) is used to induce a negative pressure or vacuum within the structure (9) so that photo resist will be pulled up through the coat head (3). In this embodiment, the reservoir (4) is open to the atmosphere so that the pressure of the photo resist inside the structure (9) will be less than the pressure of the photo resist in the reservoir. Thus, photo resist will be induced up through the coat head (3) by the pressure differential between the reservoir (4) and the structure (9).

Figure 6:
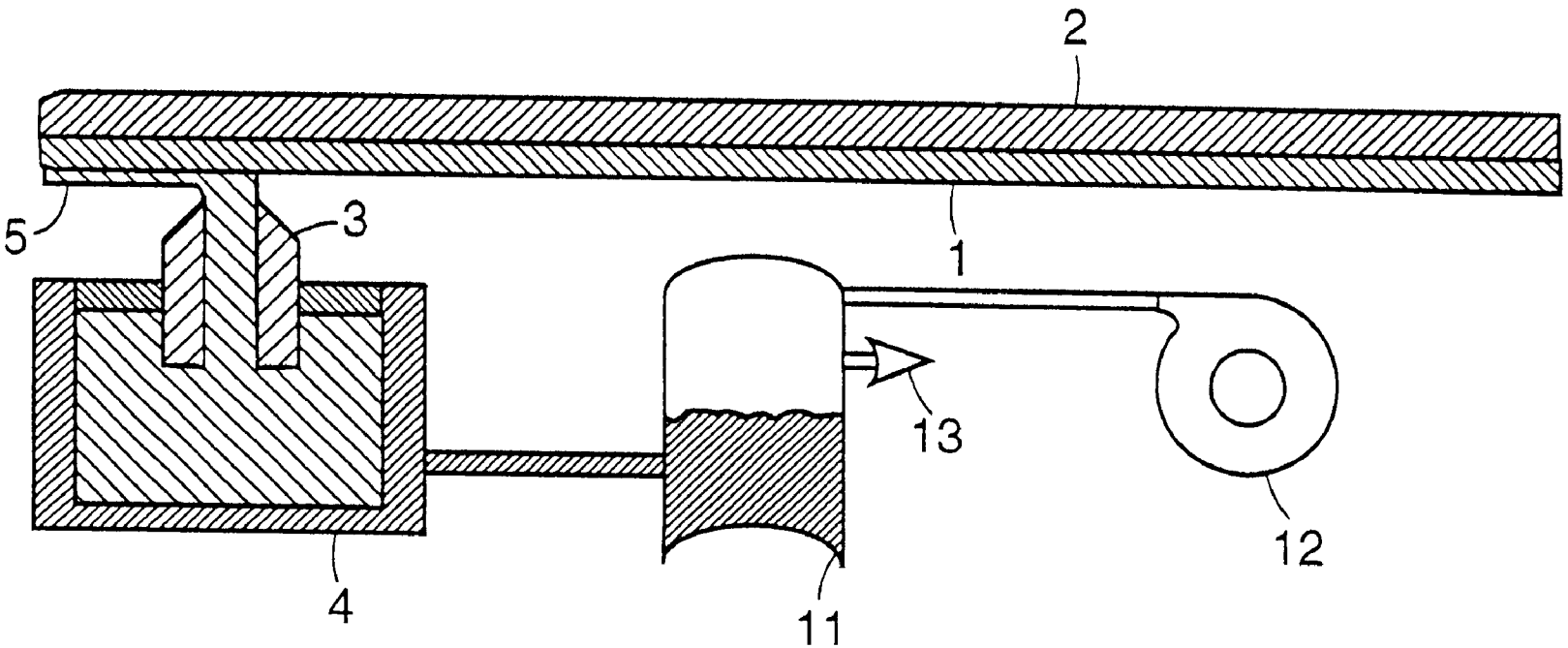
FIG. 6 is a diagram of an embodiment of the invention.

Referring to FIG. 6, there is described an embodiment of the invention. A gas pump (12) is connected to a holding tank (11). Photo resist comprises the lower portion of the holding tank (11) while less dense gas (i.e., nitrogen, etc.) resides in the upper portion of the holding tank (11). The gas pump (12) induces a positive pressure in the holding tank (11) which pushes photo resist into the reservoir (4) and up into the coat head (3). In this embodiment, the reservoir (4) is closed. The system may also be equipped with a pressure release valve (13) that regulates the pressure within the holding tank (11). When the pressure becomes too great, excess gas can escape through the pressure release valve (13).

Figure 7:
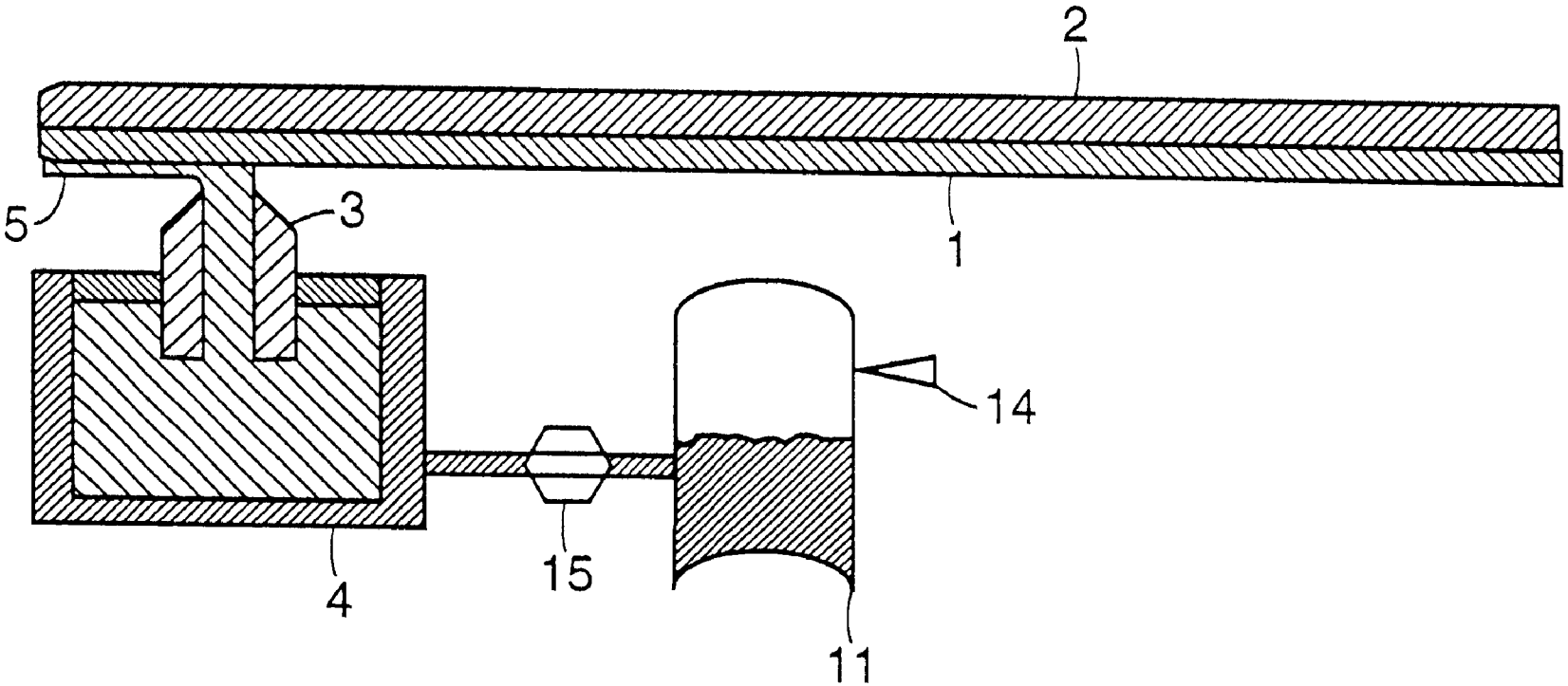
FIG. 7 is a diagram of an embodiment of the invention.

Referring to FIG. 7, a further embodiment of the invention is described. A holding tank (11) is partially filled with photo resist and partially filled with a gas. An intake valve (14) is provided for inputting gas into the holding tank (11) to pressurize the gas and photo resist in the holding tank (11). The holding tank (11) is connected to the reservoir (4) with a pressure regulator (15) between. The pressure may be initially charged to a high pressure in the holding tank (11). The pressure regulator (15) reduces the pressure so that the pressure in the reservoir (4) and coat head (3) is only slightly elevated. In this manner, the pressure in the coat head (3) may be maintained constant by the compressed gas in the holding tank (11) regulated by the pressure regulator (15). Once the pressure in the holding tank (11) becomes equal to the desired pressure in the reservoir (4), the holding tank (11) must be recharged via the intake valve (14).

In all of these embodiments the width and height of the coat head (3) may be modified or adjusted to control the flow of photo resist through the coat head (3). A wider coat head (3) allows the photo resist to flow more freely, while a thinner coat head (3) will restrict the flow. Similarly, a taller coat head (3) will restrict the flow, while a shorter coat head (3) will allow less restricted flow. Given the desired thickness of the photo resist layer to be applied, the coat head height and width should be adjusted accordingly.

It should be noted that these systems may be used to apply any fluid substance having a viscosity of greater than thirty centipoises. While the particular embodiments for the device of the present invention as herein disclosed in detail are fully capable of obtaining the objects and advantages herein stated, it is to be understood that they are merely illustrative of the presently preferred embodiments of the invention and that no limitations are intended by the details of construction or design herein shown other than as described in the appended claims.

I claim:

1. A system for coating a flat substrate with liquid, the system comprising:

a coat head including an orifice configured to be filled with liquid by capillary action;

a mover of the substrate into contact with a meniscus of the liquid at the orifice; and a source of negative pressure proximate to the meniscus for drawing the liquid through the coat head.

2. The system of claim 1, wherein the source of negative pressure includes a structure that surrounds the substrate, and a pump coupled to the structure for creating a presure within the structure that is negative relative to outside the structure.

3. The system of claim 1, wherein the mover comprises a controller for regulating the distance between the substrate and the meniscus.

4. The system of claim 1, where the mover comprises a controller for regulating the relative velocity between the substrate and the meniscus.

5. The system of claim 1, wherein the coat head is adjustable in height.

6. The system of claim 1, further comprising the liquid having viscosity of at least thirty centipoises.

7. The system of claim 6, wherein the liquid includes photoresist.

8. A system for coating a flat substrate with liquid, the system comprising:

a coat head including an orifice and configured to be filled with liquid by capillary action;

a pressurizer to form a meniscus of the liquid at the orifice;

a mover of the substrate into contact with the meniscus; and a regulator for controlling liquid pressure within the coat head.

9. The system of claim 8, further comprising a reservoir in communication with the coat head for replenishing liquid provided out from the coat head.

10. The system of claim 9, wherein the regulator is configured to control the pressure at the bottom of the coat head so that the pressure is constant and greater than atmospheric pressure.

11. The system of claim 9, wherein the viscosity of the liquid is at least thirty centipoises.

12. The system of claim 11, wherein be liquid includes photoresist.

13. The system of claim 8, the mover includes a vacuum chuck.

14. The system of claim 8, further comprising a holding tank for the liquid, wherein the pressurizer includes a valve for providing gas to the holding tank.

15. The system of claim 8, wherein the coat head is adjustable in height and/or cross-sectional area.

16. A system for coating a flat substrate with liquid, the system comprising:

a coat head including an orifice configured to be filled with liquid by capillary action, the coat head having an adjustable cross-sectional area, wherein the coat head is adjustable in height;

a pressurizer to form a meniscus of the liquid at the orifice: and a mover of the substrate into contact with the meniscus.

17. The system of claim 16, wherein the viscosity of the liquid is at least thirty centipoises.

18. The system of claim 16, wherein the mover comprises a controller for regulating the relative velocity between the substrate and the meniscus.

19. A system for coating a flat substrate with liquid, the system comprising:

a coat head including an orifice configured to be filled with liquid by capillary action;

a reservoir in communication with the coat head;

a standpipe coupled to the reservoir and extending above a level of liquid in the reservoir for providing pressure in the reservoir;

a mover of the substrate into contact with a meniscus of the liquid at the orifice; and an overflow receptacle for receiving excess liquid provided from the orifice and that does not remain as part of a coating on the flat substrate.

20. The system of claim 19, further comprising a pump for pumping the liquid from the overflow receptacle to the reservoir.

21. A system for coating a flat substrate with liquid, the system comprising:

a reservoir for holding liquid;

a coat head in communication with the reservoir and having an orifice configured to be filled with the liquid by capillary action;

a pressurizer to form a meniscus at the orifice;

a mover of the substrate into contact with the meniscus; and an overflow receptacle for receiving excess liquid provided from the coat head and that does not remain part of the coating on the flat substrate.

22. The system of claim 21, further comprising a controller for controlling a distance between the substrate and meniscus and a velocity between the substrate and meniscus

23. The system of claim 21, further comprising a pump for pumping the excess liquid from the overflow receptacle to the reservoir.

* * * * *

UNITED STATES PATENT AND TRADEMARK OFFICE

CERTIFICATE OF CORRECTION

PATENT NO. : 6,613,148 B1
DATED : September 2, 2003
INVENTOR(S) : Rasmussen

It is certified that error appears in the above-identified patent and that said Letters Patent is hereby corrected as shown below:

Column 6,
Line 3, -- wherein -- should be inserted before "the mover"

Signed and Sealed this

Seventeenth Day of February, 2004

JON W. DUDAS
*Acting Director of the United States Patent and Trademark Office*